US008746214B2

(12) United States Patent
Hall

(10) Patent No.: US 8,746,214 B2
(45) Date of Patent: Jun. 10, 2014

(54) FUEL CONTROL APPARATUS

(75) Inventor: Roger Hall, Marysville, WA (US)

(73) Assignee: Turn and Bank Holdings, Inc., Gibonsville, NC (US)

( * ) Notice: Subject to any disclaimer, the term of this patent is extended or adjusted under 35 U.S.C. 154(b) by 908 days.

(21) Appl. No.: 12/707,181

(22) Filed: Feb. 17, 2010

(65) Prior Publication Data

US 2011/0197854 A1 Aug. 18, 2011

(51) Int. Cl.
*F02M 69/22* (2006.01)

(52) U.S. Cl.
USPC ..... 123/454; 123/445

(58) Field of Classification Search
USPC ..... 123/445, 446, 454–459, 478, 479, 506, 123/510, 198 D; 261/34.2
See application file for complete search history.

(56) References Cited

U.S. PATENT DOCUMENTS

| | | | | | |
|---|---|---|---|---|---|
| 2,500,088 | A | * | 3/1950 | Mock | 261/69.2 |
| 2,771,282 | A | * | 11/1956 | Olson et al. | 261/23.2 |
| 2,824,725 | A | * | 2/1958 | Dietrich | 261/34.2 |
| 3,291,464 | A | * | 12/1966 | Hammerschmidt et al. | 261/142 |
| 3,861,366 | A | * | 1/1975 | Masaki et al. | 123/438 |
| 3,877,899 | A | * | 4/1975 | Bundy et al. | 96/428 |
| 4,034,727 | A | * | 7/1977 | Aono et al. | 123/701 |
| 4,421,089 | A | | 12/1983 | Moore, Jr. | |
| 4,648,998 | A | * | 3/1987 | Araki | 261/34.2 |
| 4,751,905 | A | * | 6/1988 | Bonfiglioli et al. | 123/470 |
| 5,353,767 | A | * | 10/1994 | Carbone et al. | 123/470 |
| 6,631,705 | B1 | * | 10/2003 | Rivera | 123/454 |
| 6,715,468 | B2 | * | 4/2004 | Uchiyama et al. | 123/339.15 |
| 2002/0046737 | A1 | * | 4/2002 | Lee et al. | 123/469 |
| 2003/0234002 | A1 | | 12/2003 | Rivera | |
| 2004/0050438 | A1 | * | 3/2004 | Haas | 137/888 |
| 2007/0006849 | A1 | * | 1/2007 | Mashiki | 123/457 |
| 2007/0221142 | A1 | * | 9/2007 | Garrabrant et al. | 122/14.1 |
| 2007/0261674 | A1 | * | 11/2007 | Akita et al. | 123/445 |
| 2008/0308068 | A1 | * | 12/2008 | Grant | 123/456 |
| 2008/0314356 | A1 | * | 12/2008 | Kamen et al. | 123/197.3 |
| 2009/0199873 | A1 | * | 8/2009 | Pruett | 134/22.12 |

OTHER PUBLICATIONS

Precision Airmotive LLC, "Training Manual: RSA Fuel Injection System", Jan. 1, 1990.

* cited by examiner

*Primary Examiner* — John Kwon
*Assistant Examiner* — Johnny H Hoang
(74) *Attorney, Agent, or Firm* — Williams Mullen, PC; Richard T. Matthews

(57) ABSTRACT

The invention, described herein, is an improved Fuel Injection Servo ("Servo") for the homebuilt aircraft. The Servo has been designed to allow the manufacturer to more easily fine tune the pressure differential over the air diaphragm. The Servo also provides an idle valve that the manufacturer and homebuilder can easily fine tune. In a second embodiment, the Servo is further adapted to replace the carburetor in smaller aircraft.

11 Claims, 16 Drawing Sheets

SECTION II

SECTION II

SECTION III

SECTION IV

FUEL CONTROL APPARATUS

CROSS-REFERENCES TO RELATED APPLICATIONS STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

COPYRIGHT NOTICE

This document contains information subject to copyright protection. The copyright owner has no objection to the facsimile reproduction of anyone of the patent document or the patent, as it appears in the US Patent and Trademark Office Files or records but otherwise reserves all copyrights whatsoever.

FIELD OF INVENTION

This invention relates to a fuel injection system, and more particularly a fuel injection servo for an internal combustion engine.

BACKGROUND

Experimental aircraft is a term used to refer to aircraft which have not been proven fully in flight. However, experimental aircraft has become a common reference for homebuilt aircraft. Experimental homebuilt aircraft ("homebuilt aircraft") are constructed by a homebuilder; that is, homebuilt aircraft are not built by a licensed aircraft manufacturer. Generally, about 51% of a homebuilt aircraft is constructed by a private individual; the remaining portion of homebuilt aircraft is usually from a kit that is assembled by a manufacturer. The fuel injection system of a homebuilt aircraft is bought from the manufacturer.

Homebuilt, or any other aircraft, have either a Multi-Point Injection System ("MPIS") or a carburetor. Smaller aircraft commonly have a carburetor. In a MPIS one injector supplies fuel directly to a cylinder of the engine. In a Single-Point Fuel Injection System ("SPIS"), fuel is injected at a single place and then distributed to each cylinder of the engine.

Fuel injection systems are designed to meter fuel in direct ratio to the volume of air being consumed by the engine at any given time. Generally, an engine driven pump receives fuel from the fuel tank and supplies that fuel to a fuel injection servo. Fuel injection servos are well known in the art. The "RSA Fuel Injection System, Training Manual" written by Precision Airmotive Corporation, is hereby incorporated, in its entirety, by reference.

Fuel injection servos are tuned in the factory before shipment to the homebuilder. However, because homebuilt aircraft come in varying sizes, the fuel injection servo may need to be fine tuned for optimal results. A fuel injection servo will get peak performance when a maximum air pressure differential signal is received by the inlet of the servo. Prior to leaving the factory, a fuel injection servo is tuned to a standard differential air pressure. Because of tolerances allowed in manufacture of the servos, the shape of the venturi (500) will have minor variance.

FIGS. 1 and 1A show a fuel injection servo known in the art. The size of the venturi is definite. To obtain a standard differential air pressure, the venturi will sometimes be filed down by hand. Once the shape of the venture is changed, its performance can only be verified with the proper airflow equipment. This cannot be done in the field.

Referring to FIG. 2, the idle valve is connected to the throttle linkage. The idle valve effectively reduces the area of the main metering jet for accurate metering of the fuel in the idle range. The idle control valve is opened/closed by rotating a flat metal plate over the valve's opening. As with any mechanical function that creates a metal on metal situation, the idle control valve starts to wear.

Referring to FIG. 3, to ensure that the idle valve is properly seals, a strong spring is used to hold the valve in place. To fine tune the idle valve, the spring must be changed. When the idle valve bears a higher load, caused by the spring, the idle valve tends to wear quicker.

Fuel injection servos for homebuilt aircraft are normally MPIS. Smaller aircraft generally have carburetors. The carburetor has several deficiencies. First, carburetor icing becomes a problem. Carburetor icing is caused by a change in temperature due to fuel vaporization prior to entering the carburetor. Vaporizing fuel can also cause the throttle valve of the carburetor to freeze. This scenario leaves the engine without air. The homebuilder can manage this weakness in the carburetor by installing a heating device for the carburetor. However, small aircraft may not have room for a heating device. Further, heating devices cause power loss and need constant pilot attention. Second, carburetors are sensitive normal operations. Third, it is difficult to adjust a carburetor to optimize fuel flow. Finally, an aircraft cannot fly upside down with a carburetor because airflow through the carburetor can go only one direction. Replacing a carburetor with a fuel injection system would solve these problems. However, a MPIS does not exit for smaller planes. Conceivably, the MPIS could be adapted, after market, for the smaller aircraft. However, a better solution is a SPIS which is made for the smaller aircraft.

Another problem that smaller aircraft face is delayed response at sudden throttle opening or acceleration. This is a natural occurrence in smaller aircraft because the fuel discharge point is further away from the cylinders.

The invention, described herein, is an improved Fuel Injection Servo ("Servo") for the homebuilt aircraft. The Servo has been designed to allow the manufacturer to more easily fine tune the pressure differential over the air diaphragm. The Servo also provides an idle valve that the manufacturer and homebuilder can easily fine tune. In a second embodiment, the Servo is further adapted to replace the carburetor in smaller aircraft.

BRIEF DESCRIPTION OF THE SEVERAL VIEWS OF THE DRAWINGS

Other features and advantages of the present invention will become apparent in the following detailed descriptions of the preferred embodiment with reference to the accompanying drawings, of which.

DETAILED DESCRIPTION OF THE INVENTION

In the description of the invention above and in the detailed description of the invention, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally. Referring now in detail to the FIGS. 1 though 11A, wherein the same numbers are used where applicable, a fuel control apparatus, namely a Servo, constructed in accordance with an embodiment of the invention is identified generally as the reference number 100. Although the description below anticipates the Servo (100) will be used on homebuilt aircraft, it will be obvious to those skilled in the art that the Servo (100) can be used on any type of aircraft and generally, on any combustion engine of appropriate size.

Figure 4:
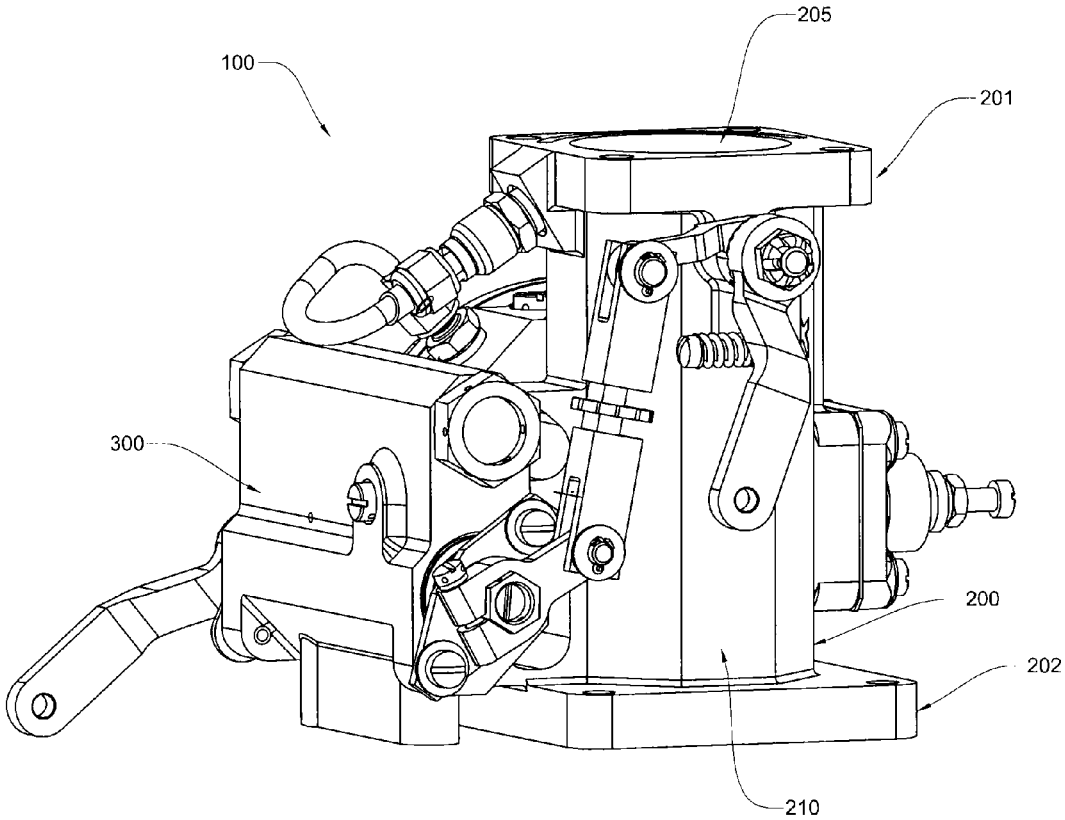
FIG. 4 is an elevation view of the inventive fuel injection servo.
Figure 5:
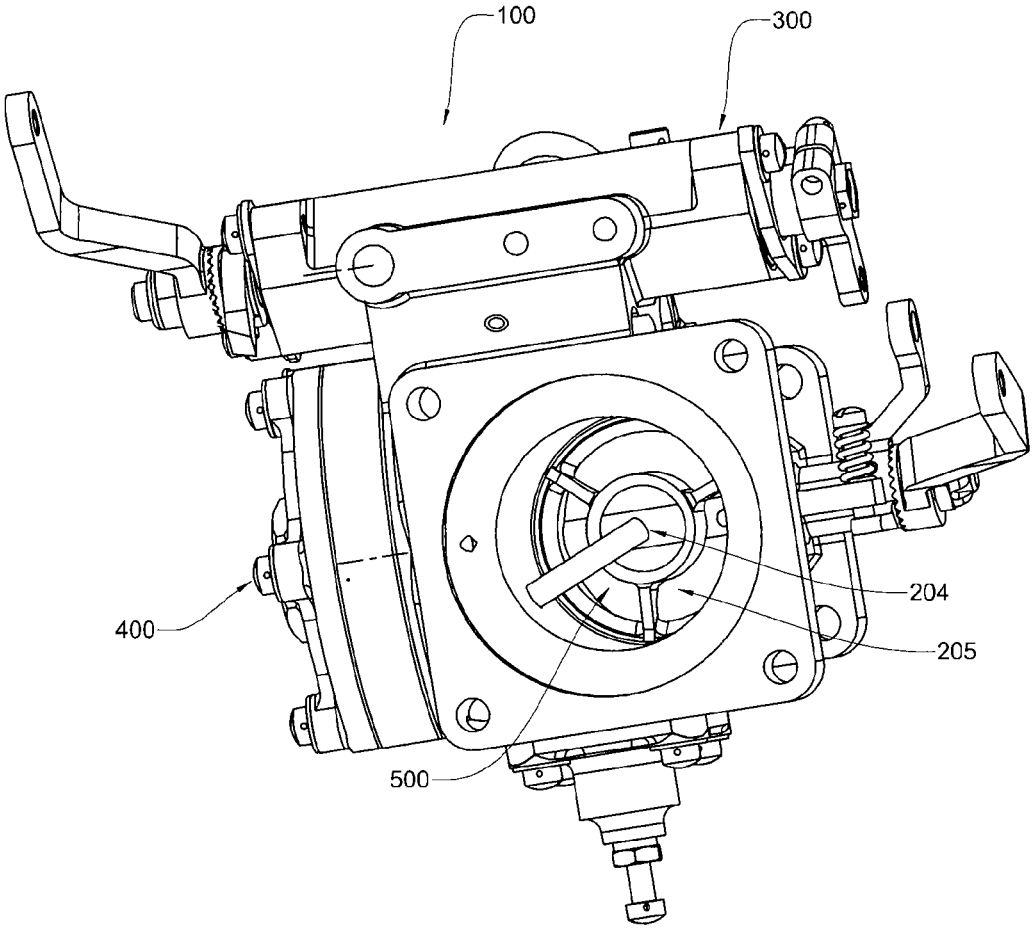
FIG. 5 is an end view of the inventive fuel injection system.
Figure 7:
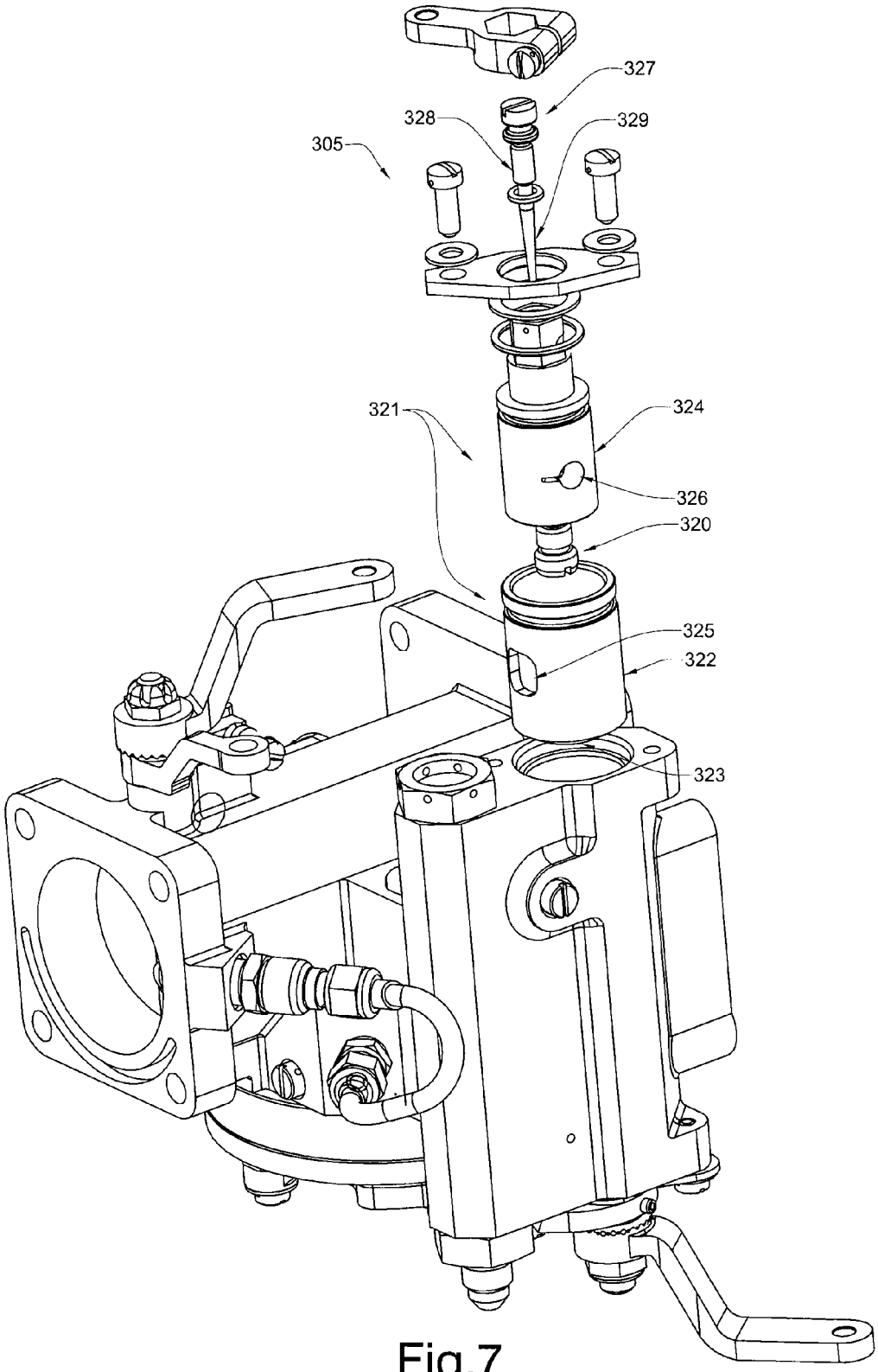
FIG. 7 is an exploded view of the idle valve for the inventive fuel injection servo.

Referring to FIGS. 4 and 5, The Servo (100) comprises an air passage mechanism ("throttle body") (200), a fuel pressure modifying mechanism (300), and a fuel metering mechanism (400). The throttle body (200) comprises a central section (210) that defines a plenum (205). The throttle body (200) further comprises a first end (201) and a second end (202). A venturi (500) is mounted within the plenum (205) at a location between the first end (201) and the second end (202). Also mounted within the plenum (205) is a throttle valve (204). The fuel pressure modifying mechanism (300) comprises a mixture control valve and an idle valve (305), as shown in FIG. 7.

The underlying principles of the Servo (100) are well known in the art. Generally, air flows through the throttle body (200) and works in combination with the venturi (500), fuel metering system (400), and other components to provide the proper amount of fuel to the combustion chambers of the engine. The amount of fuel received in the combustion chamber is directly proportional to air flow. This is accomplished by channeling ambient air impact pressure and venturi suction pressure to opposite sides of an air diaphragm into the fuel metering system (400).

Figure 8:
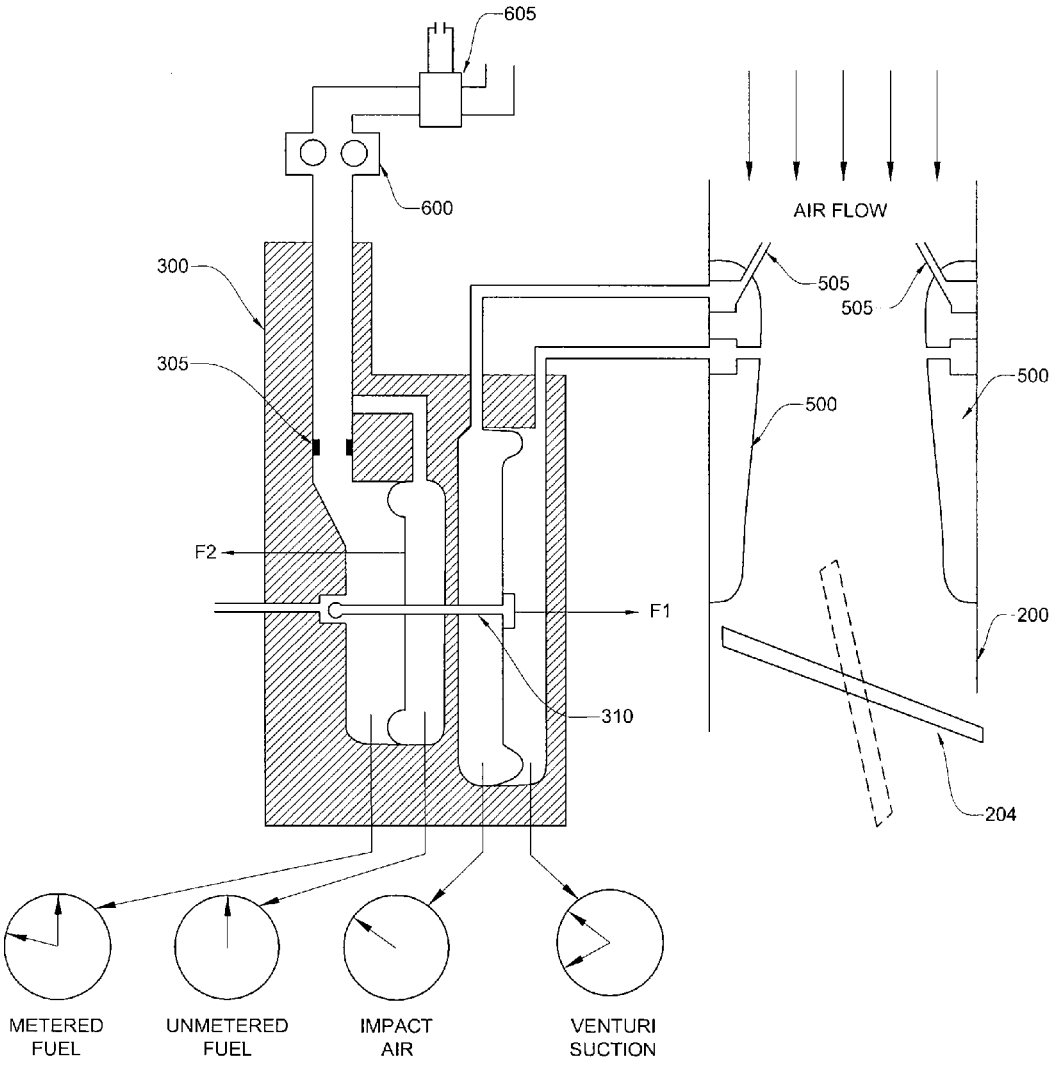
FIG. 8 is a schematic of the fuel system.

More specifically, referring to FIG. 8, fuel is supplied to the engine from the aircraft fuel system. This system usually comprises an engine driven pump ("fuel pump") (600) and a boost pump (605) that supplies fuel, at a relatively constant pressure, to the pressure modifying mechanism (300).

Engine manufacturers specify the required fuel pump (600) pressure for a specific type of fuel injection servo. the fuel injection servo is calibrated at the servo inlet pressure. The fuel injection servo is tuned to assure that metered fuel flow will not be affected by changes in inlet fuel pressure caused by boost pump ON or OFF operations.

Air flow through the throttle body (200) generates an air pressure differential which is the difference between the impact pressure and the venturi suction pressure. This pressure differential applied across the air diaphragm exerts force F1. Fuel flow to the engine, passes through a main metering jet (305), generating a fuel pressure differential which is the difference between un-metered fuel and metered fuel pressure. This pressure deferential, applied across the fuel diaphragm exerts force F2.

When F1 is equal to F2, the servo valve (310) is held in a fixed position allowing discharge of enough metered fuel to maintain a pressure balance. If the throttle valve (204) is opened to increase power, air flow increases resulting in a increase pressure differential across the air diaphragm asserting a force of F1'. F1' causes the servo valve (310) to move to the right causing a decrease in differential pressure across the fuel diaphragm which asserts a force F2'. When F2' equals F1', the system reaches a steady state condition described above. This sequence of operations is true over all power changes.

In this system, it is essential to have the largest differential pressure over the air diaphragm. One way to adjust the differential pressure is by adjusting the venturi (500).

Figure 1:
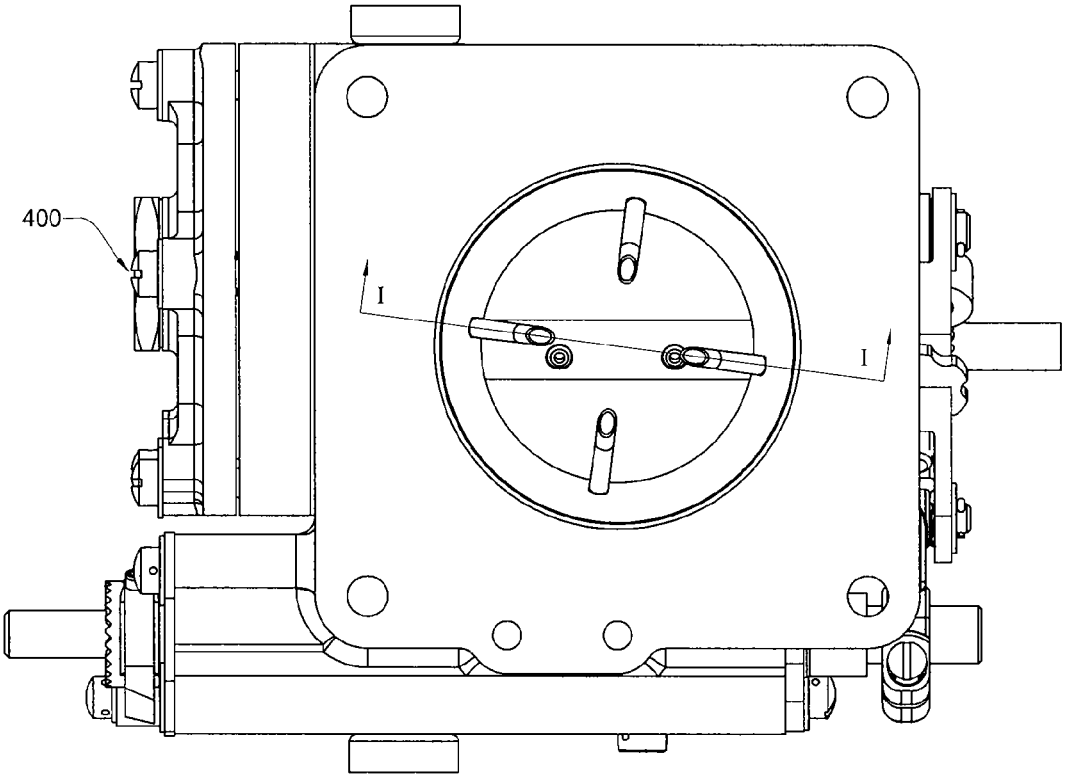
FIG. 1 is a top elevation view of a fuel injection servo known in the art.
Figure 1A:
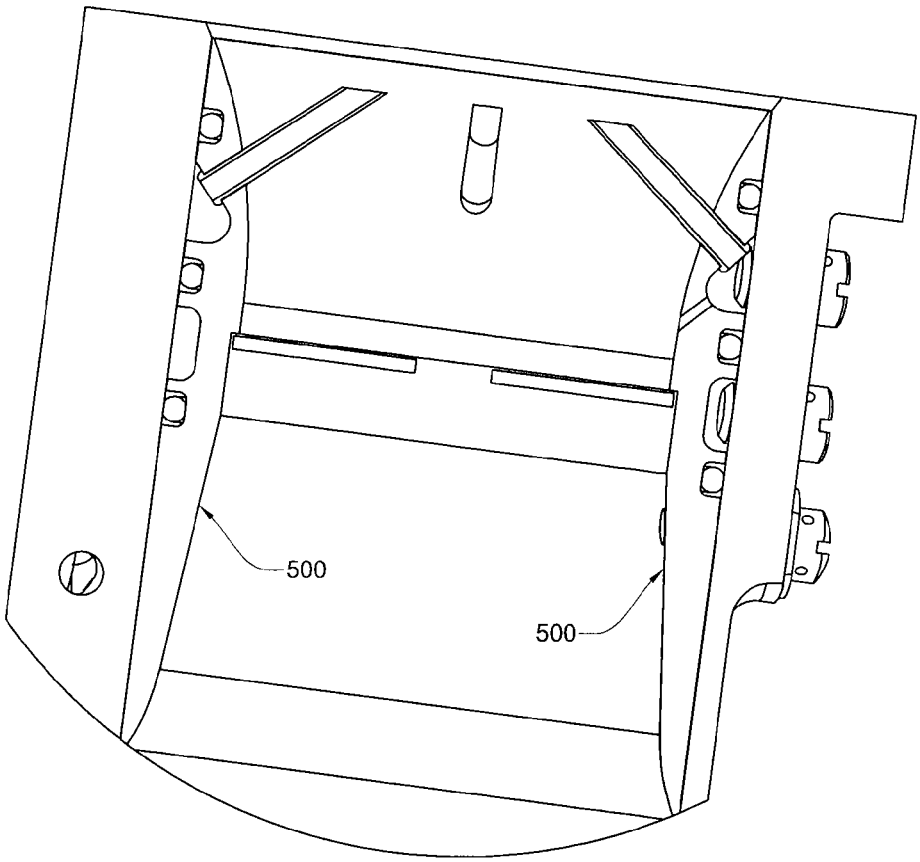
FIG. 1A shows cross-section I-I taken from FIG. 1.
Figure 2:
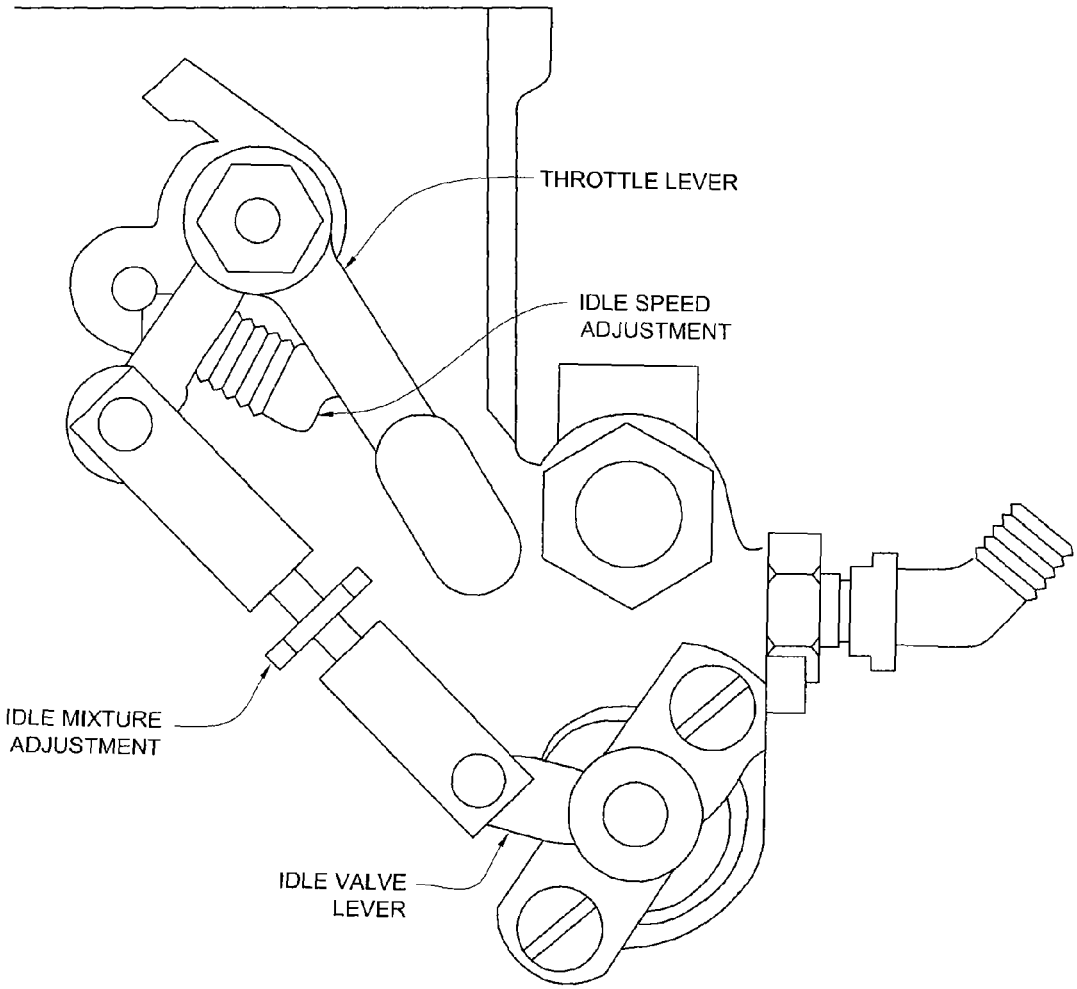
FIG. 2 is a schematic view showing the relationship of idle valve to the throttle linkage.
Figure 3:
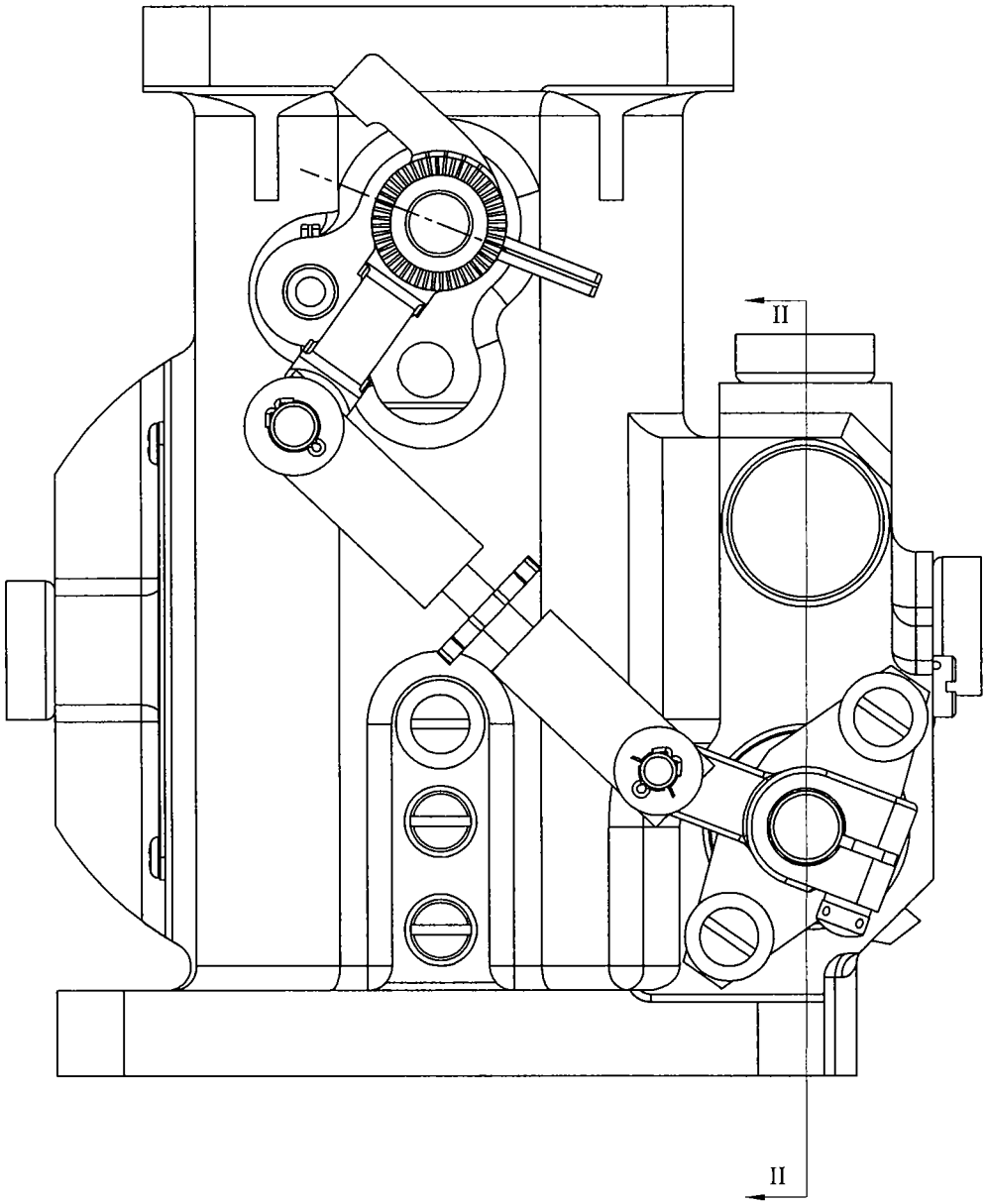
FIG. 3 shows a side view of a fuel injection servo known in the art.
Figure 3A:
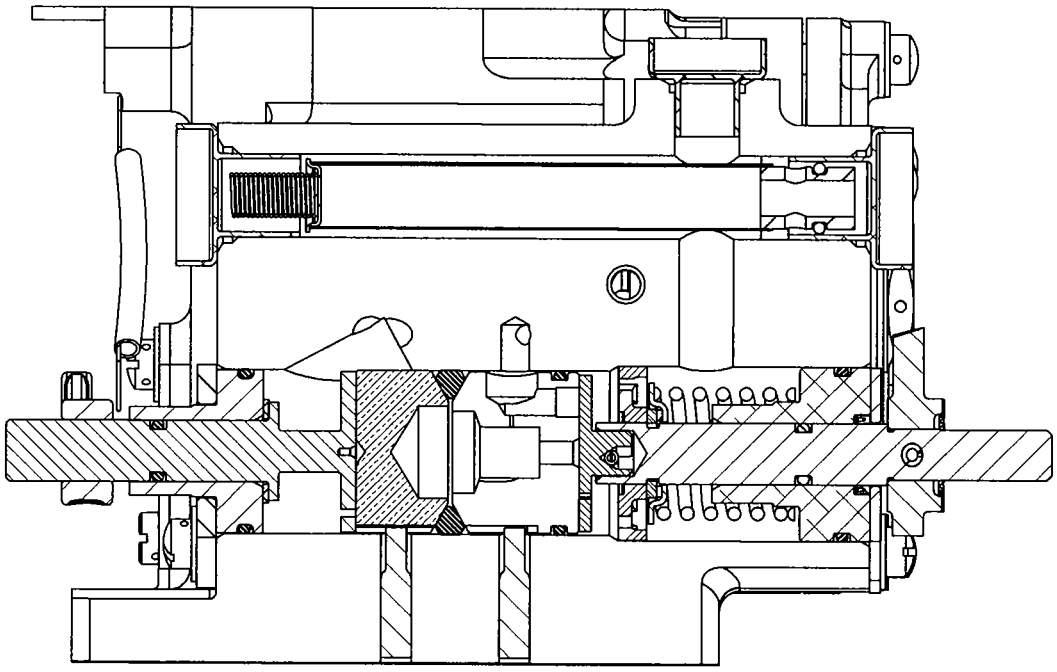
FIG. 3A shows cross-section II-II taken from FIG. 3.

FIGS. 1 and 1A shows a fuel injection servo that is well known in the art. As described above, a fuel injection servo can be tuned by changing the size of the venturi (500). This is difficult and time consuming.

Figure 9:
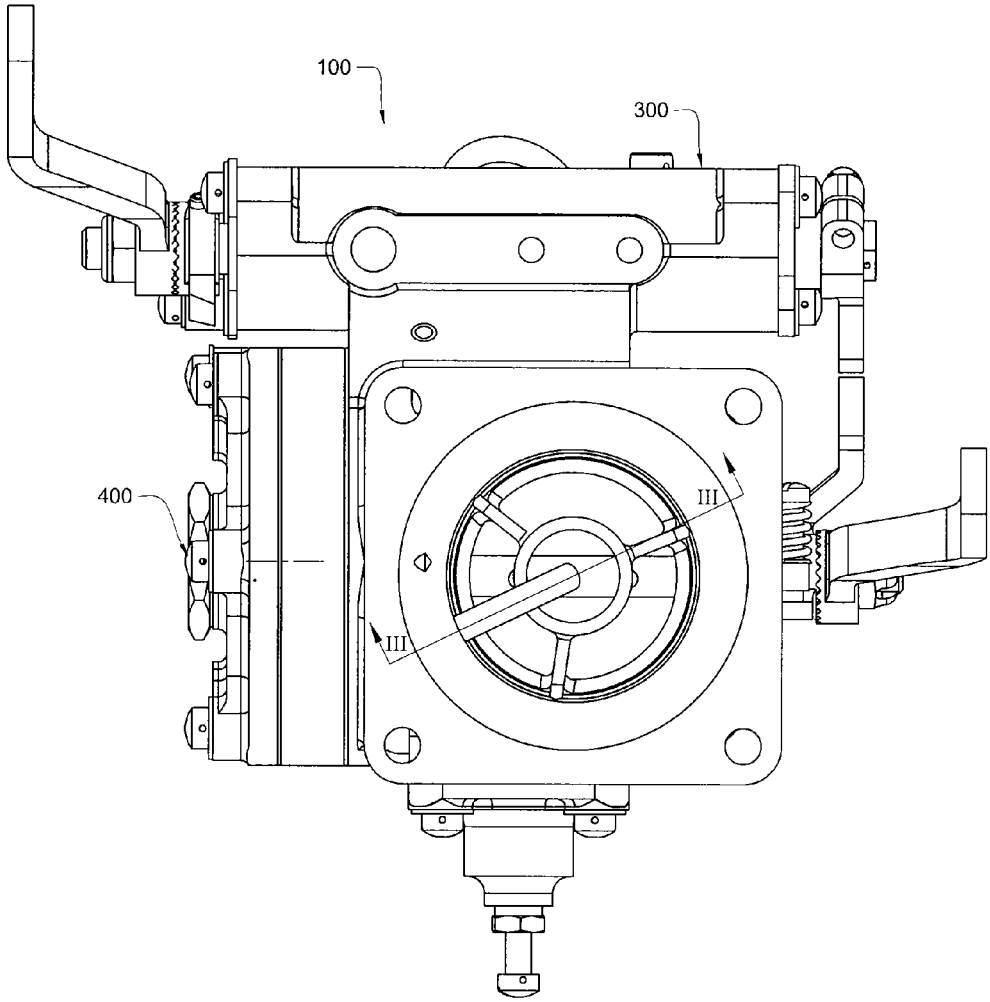
FIG. 9 is an end view of the inventive fuel injection servo.
Figure 9A:
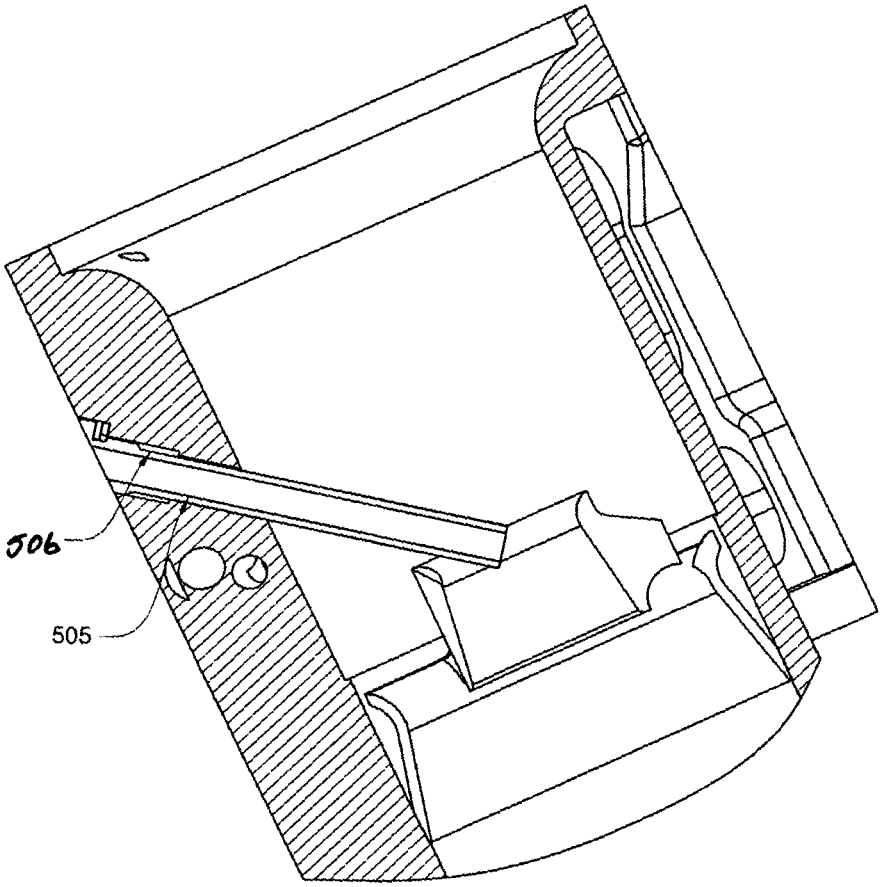
FIG. 9A shows cross-section III-III taken from FIG. 9.

Referring to FIGS. 9 and 9A, the Servo (100) allows the manufacturer to easily adjust the differential air pressure over the air diaphragm. The Servo (100) has a single venturi suction tube (505) and a shim (506). The venturi suction tube (505) senses the venturi pressure. The shim (506) allows the manufacturer to make minor changes in the location of the venturi suction tube (505). Consequently, it is easier for the manufacturer to adjust the venturi pressure prior to leaving the factory.

Figure 6:
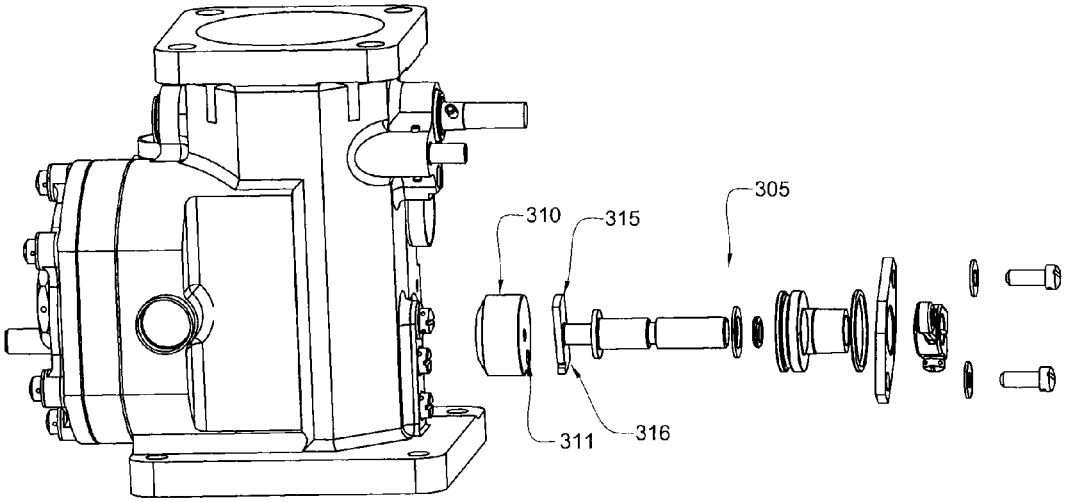
FIG. 6 is an exploded view of the idle valve for a fuel injection servo known in the art.

The amount of fuel received by the engine at lower speeds can be optimized by modifying the idle valve (305). FIG. 6 shows an exploded view of a idle valve (305) known in the art. The idle valve (305) comprises a metering jet (310) and a rotating plate (315). The metering jet (310) defines a metering jet hole (311) that allows fuel to flow into the Servo (100). The rotating plate (315) defines a notch (316). As the rotating plate (315) turns the size of the metering jet hole (311) changes depending on up the location of the notch (316).

FIG. 7 shows an exploded view of the idle valve (305) on the Servo (100). The idle valve (305) comprises a metering jet (320) and a means to modify the metering jet (328). The metering jet (320) screws into a barrel valve (321). The barrel valve (321) is comprised of a sleeve piece (322) and a barrel (324). The barrel (324) fits into the sleeve (322). The sleeve defines an outlet hole (325). The barrel defines a notched hole (326). The effective size of the outlet hole (325) is reduced depending on the location of the notched hole (326). That is when the notched holed (326) is lined up with the outlet hole (325), fuel flow through the metered jet (320) is at a maximum.

The means to modify the metering jet (328) comprises a needle valve (329). The needle valve (329) sits inside the barrel valve (321). Depending on the position of the needle valve (329) the effective size of the metering jet (320) can decrease thereby, decreasing the amount of fuel the engine receives. The position of the needle valve (329) is controlled by screw (327).

The screw (327) is accessible to the homebuilder, allowing the homebuilder to fine tune the amount of metered fuel entering the engine. Also, because of the smooth travel and minimal loading of the barrel valve (321), wear and tear is minimal. Additionally, if a component of the idle valve (305) wears, only that component would need to be replaced.

In a second embodiment, the Servo (100) is SPIS which replaces the carburetor of smaller aircraft. Carburetor flaws are discussed above. Homebuilders who prefer a fuel injection system can adapt a MPIS for their smaller aircraft. However, adaptation of a MPIS is not an ideal solution for the homebuilder.

Figure 10:
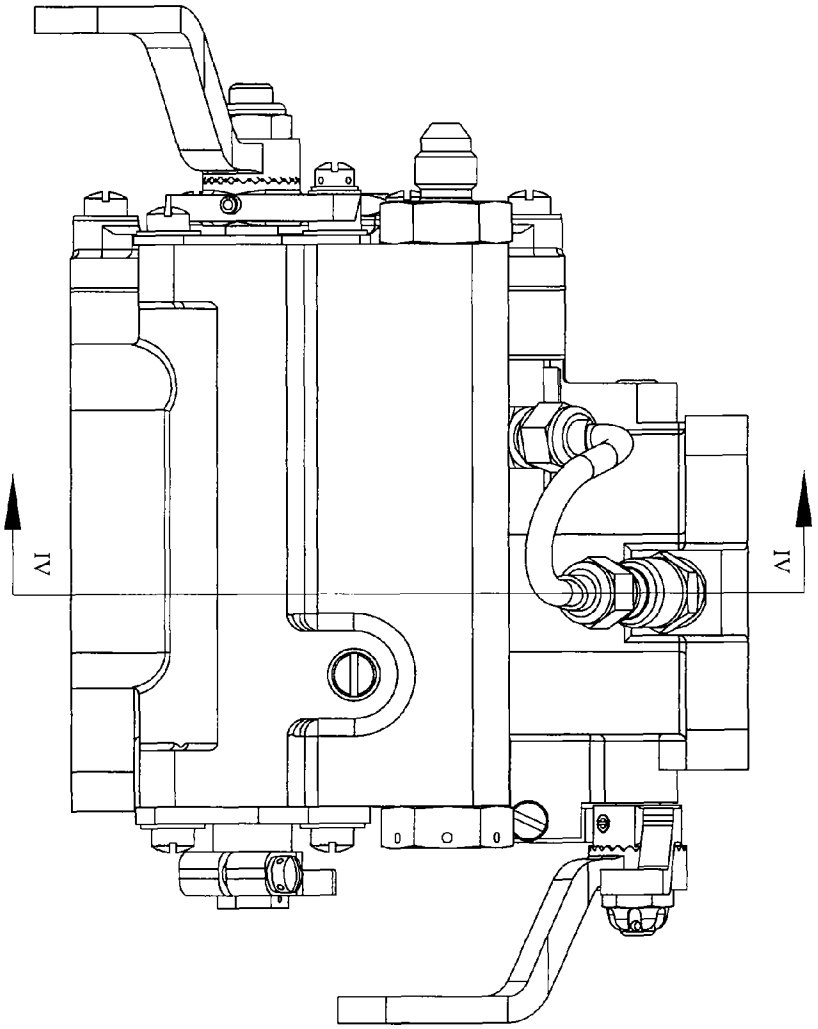
FIG. 10 is a side view of the inventive fuel control apparatus.
Figure 10A:
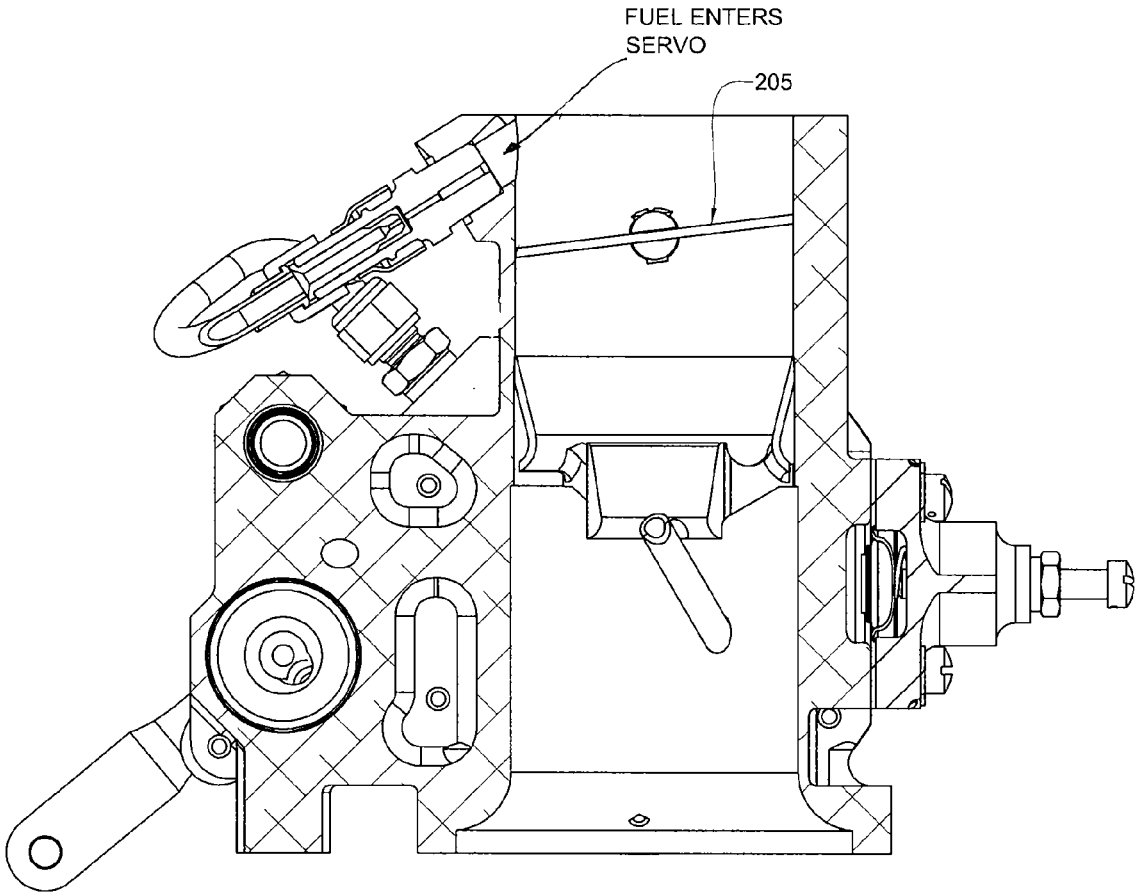
FIG. 10A shows cross-section IV-IV taken from FIG. 10.

Carburetors, known in the art, receive fuel at a point above the throttle valve leaving fuel to vaporize causing icing on the carburetor and, in some cases, icing on the throttle valve. Referring to FIGS. 10 and 10A, fuel enters the Servo (100) at a position downstream the throttle valve (205).

Figure 11:
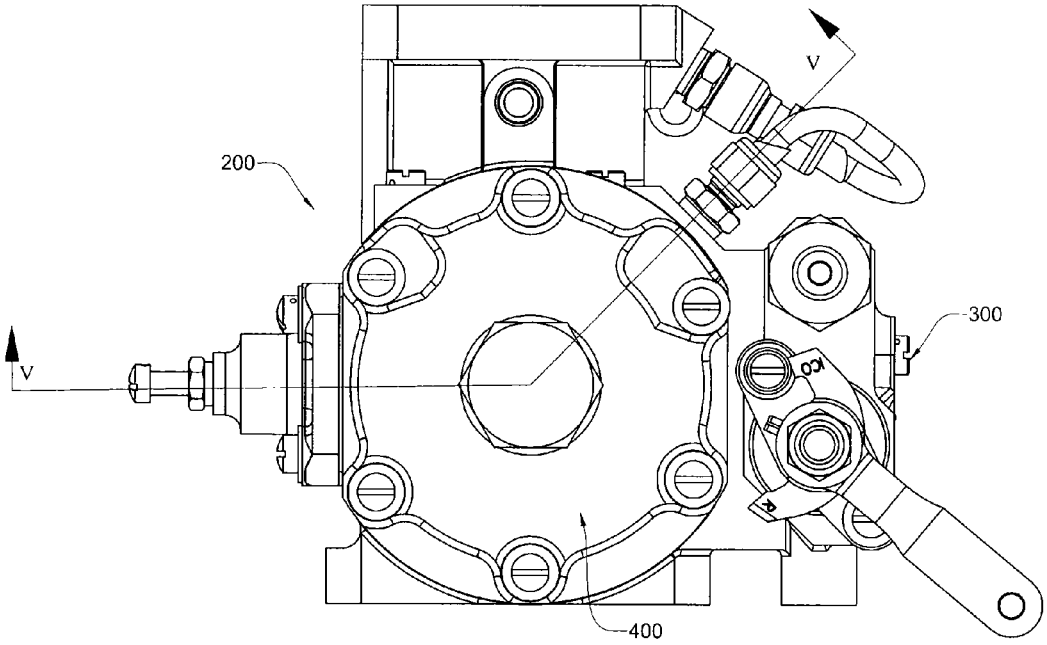
FIG. 11 is a side view of the inventive fuel injection servo.
Figure 11A:
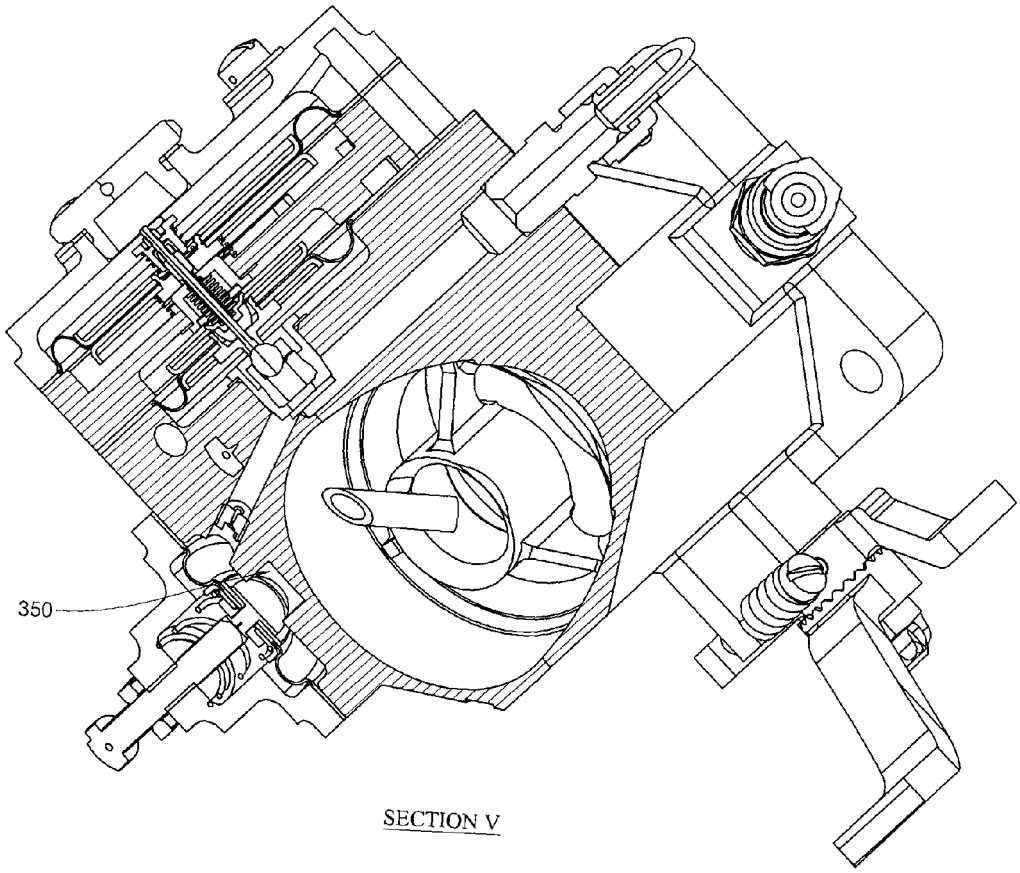
FIG. 11A shows cross-section V-V taken from FIG. 11.

As discussed above, smaller aircraft have a delayed response at lift off (or acceleration). This is a natural occurrence in smaller aircraft because the fuel discharge is further away from the cylinders. Consequently, in the second embodiment, the fuel pressure modifying mechanism (300) further comprises an accelerator pump with a fuel reservoir (350) to compensate for the distance between the fuel discharge and the cylinder, as shown in FIGS. 11 and 11A.

Accelerator pumps are well known in the art. The greater inertia of liquid gasoline, compared to air means that if the throttle is suddenly opened, the airflow will increase more rapidly than the fuel flow, which can cause a temporary lean condition which causes the engine to stumble under acceleration. This is remedied by the use of an accelerator pump.

The fuel reservoir (350) holds a reserved amount of fuel to compensate for the distance between the fuel outlet and the cylinder. When the throttle valve (205) opens there exists an increase in the pressure differential across the air diaphragm which causes the servo valve (310) to open creating a sudden drop in metered fuel pressure and causing the reservoir (350) to empty. When the throttle valve (205) is still or is closing and the metered fuel stabilizes, the fuel reservoir (350) fills.

What is claimed is:

1. In a fuel injection system for an internal combustion engine, said fuel injection system comprising:

(a) an air passage mechanism where the air passage mechanism comprises a central section;

(i) where the central section defines a plenum allowing air passage through the air passage mechanism;

(ii) where the central section further comprises a venturi and a throttle valve mounted within the plenum; where flow of air through the air passage mechanism generates an air pressure differential which is the difference between impact pressure and venturi suction pressure;

(iii) the air passage mechanism comprising an air pressure differential adjustment mechanism comprising a single venturi suction tube and a shim; where the venturi suction tube is configured to allow measurement of the venturi suction pressure; where the venturi tube is attached to the shim; where the shim is mounted within the plenum and configured to be manipulated to adjust the location of the venturi suction tube to thereby adjust the venturi suction pressure;

(b) a fuel pressure modifying mechanism which receives fuel from a supply and delivers the fuel at a pressure different from the supply comprising a fuel regulator and an idle valve; and (c) a fuel metering mechanism.

2. The fuel injection system of claim 1 where the idle valve comprises an integrated metering jet where there is a flow of liquid through the metering jet and a mechanism to modify the flow through metering jet where:

(a) the metering jet extends axially from a near end of a barrel valve and rotatably mates with a sleeve valve; where the barrel valve defines a notched hole and the sleeve defines an outlet hole;

(b) where the mechanism to modify the flow through the metering jet comprises a needle valve; where the needle valve rotatably mates with a far end of the barrel valve; where the flow through the metering jet is adjusted by extending or contracting the needle valve to or from the far end of the barrel valve.

3. The fuel injection system of claim 2 where the flow through the metering jet is increased by aligning the notched hole and the outlet hole.

4. The fuel injection system of claim 2 where the needle valve is rotated into the barrel valve by a screw; where the flow through the metering jet is decreased by rotating the needle valve into the barrel valve.

5. In a fuel injection system for an internal combustion engine, said fuel injection system comprising:

(a) an air passage mechanism where said air passage mechanism comprises a central section:

(i) where the central section defines a plenum allowing air passage through the air passage mechanism;

(ii) where the central section further comprises a venturi and a throttle valve mounted within the plenum; where said flow of air through the air passage mechanism generates an air pressure differential which is the difference between impact pressure and venturi suction pressure;

(iii) where fuel is delivered downstream of the throttle valve;

(iii) the air passage mechanism comprising an air pressure differential adjustment mechanism comprising a single venturi suction tube and a shim; where the venturi suction tube is configured to allow measurement of the venturi suction pressure; where the venturi tube is attached to the shim; where the shim is mounted within the plenum and configured to be manipulated to adjust the location of the venturi suction tube to thereby adjust the venturi suction pressure;

(b) a fuel pressure modifying mechanism which receives fuel from a supply and delivers said fuel at a pressure different from said supply comprising a fuel regulator and an idle valve;

(c) a fuel metering mechanism; and (d) an accelerator pump.

6. The fuel injection system of claim 5 where the idle valve comprises an integrated metering jet where there is a flow of liquid through the metering jet and a mechanism to modify the flow through metering jet where:

(a) the metering jet extends axially from the near end of a barrel valve and rotatably mates with a sleeve valve; where the barrel valve defines a notched hole and the sleeve defines an outlet hole;

(b) where the mechanism to modify the flow through the metering jet comprises a needle valve; where the needle valve rotatably mates with the far end of the barrel valve;

where the flow through the metering jet is adjusted by extending or contracting the needle valve to or from the far end of the barrel valve.

7. The fuel injection system of claim 6 where the flow through the metering jet is increased by aligning the notched hole and the outlet hole.

8. The fuel injection system of claim 6 where the needle valve is rotated into the barrel valve by a screw; where the flow through the metering jet is decreased by rotating the needle valve into the barrel valve.

9. The fuel injection system of claim 6 where said accelerator pump comprises a fuel reservoir.

10. The fuel injection system of claim 9 where said fuel reservoir empties when an increase of differential pressure creates a sudden drop in metered fuel pressure.

11. The fuel injection system of claim 10 where said fuel reservoir fills when the throttle valve is still or closing and the amount of metered fuel pressure stabilizes.

* * * * *